US008117861B2

(12) United States Patent
Husband et al.

(10) Patent No.: US 8,117,861 B2
(45) Date of Patent: Feb. 21, 2012

(54) COOLING ARRANGEMENT FOR AN ELECTRICAL CONNECTOR FOR A SUPERCONDUCTOR

(75) Inventors: Stephen M. Husband, Derby (GB); Alexander C. Smith, Holmfirth (GB); Stephen M. Harrison, Wallingford (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 12/992,606

(22) PCT Filed: May 18, 2009

(86) PCT No.: PCT/GB2009/001246

§ 371 (c)(1),
(2), (4) Date: Nov. 15, 2010

(87) PCT Pub. No.: WO2009/150398

PCT Pub. Date: Dec. 17, 2009

(65) Prior Publication Data

US 2011/0061851 A1 Mar. 17, 2011

(30) Foreign Application Priority Data

Jun. 12, 2008 (GB) ..... 0810702.1

(51) Int. Cl.
*F25D 23/12* (2006.01)

(52) U.S. Cl. ..... 62/259.2; 62/51.1; 62/6

(58) Field of Classification Search ..... 62/259.2, 62/51.1, 6

See application file for complete search history.

(56) References Cited

U.S. PATENT DOCUMENTS 4,625,193 A * 11/1986 Purcell ..... 335/216
5,884,485 A * 3/1999 Yamaguchi et al. ..... 62/3.2
2007/0139833 A1 6/2007 Sargent
2008/0115510 A1 5/2008 Crowley et al.

FOREIGN PATENT DOCUMENTS

EP 1 279 886 A2 1/2003
WO WO 97/24733 7/1997

OTHER PUBLICATIONS

Search Report issued in PCT/GB2009/001246, mailed Sep. 3, 2009.
Written Opinion issued in PCT/GB2009/001246, mailed Sep. 3, 2009.

* cited by examiner

*Primary Examiner* — Cheryl J Tyler
*Assistant Examiner* — Melanie Reuter
(74) *Attorney, Agent, or Firm* — Oliff & Berridge, PLC

(57) ABSTRACT

A cooling arrangement for an electrical connector for a superconductor including at least one superconductor arranged in a container and the container is arranged in a vacuum chamber. A cryocooler is thermally connected to the container to cool the container and the contents of the container including the superconductor. The electrical connector extends through the vacuum chamber and the container to the at least one superconductor. The electrical connector has a thermally conducting and electrically insulating arrangement. The thermally conducting and electrically insulating arrangement comprises an electrically insulating member contacting the electrical connector. A thermally conducting member contacts the electrically insulating member and the thermally conducting member is thermally connected to the to cool the electrical connector.

13 Claims, 3 Drawing Sheets

COOLING ARRANGEMENT FOR AN ELECTRICAL CONNECTOR FOR A SUPERCONDUCTOR

The present invention relates to a cooling arrangement for an electrical connector for a superconductor and in particular to a cooling arrangement for an electrical connector for a superconducting fault current limiter.

It is known to provide a superconductor within a container, which is located within a vacuum chamber and to provide a cryocooler to cool the container and the superconductor. The superconductor is electrically connected to other electrical components, e.g. an electrical power supply, outside the vacuum chamber by one or more electrical connectors, which pass through the wall of the vacuum chamber and the container.

The arrangement of these electrical connectors is critical to successful operation of the superconductor. The electrical connectors must have very low electrical resistance, for example the electrical connectors may be copper, but this creates two problems with the use of these electrical connectors.

Firstly the $I^2R$ losses of the electrical connectors affect the size of the cryogenic cooler and the overall system and therefore the $I^2R$ losses, the electrical resistance losses, of the electrical connectors must be minimised. To minimise the $I^2R$ losses, the electrical resistance of the electrical connectors must be reduced, minimised, and this is achieved by reducing the length and increasing the cross-sectional area of the electrical connectors.

Secondly heat from the ambient conditions outside the vacuum chamber is thermally conducted along the electrical connectors into the vacuum chamber and the container and may lead to an increase in the temperature at the interface with the superconductor. This is known as thermal heat-soak. To minimise the thermal heat-soak, the thermal resistance of the electrical connectors must be increased, maximised, and this is achieved by reducing the cross-sectional area of the electrical connectors. In most superconductor arrangements, the electrical connectors provide the largest source of heat load on the cryocooler.

Thus, it is clear that the requirement to reduce the cross-sectional area of the electrical connectors to minimise thermal heat-soak is exactly the opposite of the requirement to increase the cross-sectional area of the electrical connectors to minimise $I^2R$ losses.

For electrical connectors carrying large currents it is vital that the electrical resistance is minimised and therefore is it is necessary to cool the electrical connectors to reduce, or prevent, thermal heat-soak affecting the superconductor.

In arrangements in which the cryocooler comprises a liquid cryogen coolant, it is known to cool electrical connectors by passing a flow of boiled off vapours from the liquid cryogen coolant over and along the electrical connectors.

In arrangements in which the cryocooler does not comprise a liquid cryogen coolant, it is known to cool electrical connectors by clamping the electrical connectors between two thermally conducting members, which are thermally connected to the cryocooler. However, such an arrangement does not provide sufficient electrical isolation.

Accordingly the present invention seeks to provide a novel cooling arrangement for an electrical connector for a superconductor which reduces, preferably overcomes, the above mentioned problem.

Accordingly the present invention provides a cooling arrangement for an electrical connector for a superconductor comprising at least one superconductor arranged in a container, the container being arranged in a vacuum chamber, a cryocooler thermally connected to the container to cool the container and the contents of the container, the electrical connector extending through the vacuum chamber and the container to the at least one superconductor, the electrical connector having a thermally conducting and electrically insulating arrangement, the thermally conducting and electrically insulating arrangement comprising an electrically insulating member contacting the electrical connector, a thermally conducting member contacting the electrically insulating member and the thermally conducting member being thermally connected to the cryocooler to cool the electrical connector.

Preferably a portion of the electrical connector comprises a U-shaped plate member, the thermally conducting and electrically insulating arrangement comprises an electrically insulating plate contacting the U-shaped plate member portion of the electrical connector, the thermally conducting member contacting the electrically insulating plate and the thermally conducting member being thermally connected to the cryocooler to cool the electrical connector.

Preferably there are a plurality of electrical connectors, a portion of each electrical connector comprises a U-shaped plate member, a plurality of electrically insulating plates and a plurality of thermally conducting members, each electrically insulating plate contacting the U-shaped plate member portion of a respective one of the electrical connectors, each thermally conducting member contacting a respective one of the electrically insulating plates.

Preferably the plurality of electrical connectors are arranged around the cryocooler, the thermally conducting members being arranged on the sides of a polygon. Preferably there are six electrical connectors and each thermally conducting member being arranged on the side of a hexagon.

The thermally conducting member may comprise copper, aluminium or brass. The electrically insulating plate may comprise alumina or sapphire. The U-shaped plate member may comprise copper, aluminium or brass.

The thermally conducting and electrically insulating arrangement may comprise a hollow electrically insulating member surrounding the electrical connector, a thermally conducting member surrounding the hollow electrically insulating member, the thermally conducting member being thermally connected to the cryocooler to cool the electrical connector.

The thermally conducting member may comprise a thermally conducting plate having at least one aperture, the electrical connector extending through the at least one aperture, the hollow electrically insulating member being positioned in the at least one aperture between the at least one electrical connector and the thermally conducting plate.

The thermally conducting plate may have a plurality of apertures, a plurality of electrical connectors, a plurality of hollow electrically insulating members, each electrical connector extending through a respective one of the apertures, each hollow electrically insulating member being positioned in a respective one of the apertures, each hollow electrically insulating member being position between the respective one of the electrical connectors and the thermally conducting plate.

The thermally conducting plate may comprise an aluminium plate. The aluminium plate may be an anodised aluminium plate. The hollow electrically insulating member may comprise alumina or sapphire.

The thermally conducting and electrically insulating arrangement may comprise a hollow electrically insulating member surrounding the electrical connector, a thermally conducting member surrounding the hollow electrically insulating member, the thermally conducting member being thermally connected to the cryocooler to cool the electrical connector, a further electrical insulating member surrounding the thermally conducting member and a clamp surrounding the further electrical insulating member to compress the thermally conducting and electrically insulating arrangement.

The thermally conducting member may comprise aluminium, copper or brass. The aluminium may be anodised aluminium. The hollow electrically insulating member may comprise alumina or sapphire.

The thermally conducting member may comprise a braided conducting member.

The hollow electrically insulating member may have a slot around its periphery and the thermally conducting member may be arranged in the slot in the hollow electrically conducting member.

A conducting wool may be arranged in the slot in the hollow electrically insulating member with the thermally conducting member. The conducting wool may comprise copper wool.

The electrical connector may comprise a copper cable or a copper busbar.

The superconductor may be a superconducting fault current limiter or a superconducting coil of an electrical machine.

The container may contain a liquid cryogen to cool the superconductor. The liquid cryogen may be liquid nitrogen.

The present invention will be more fully described by way of example with reference to the accompanying drawings in which:—

Figure 1:
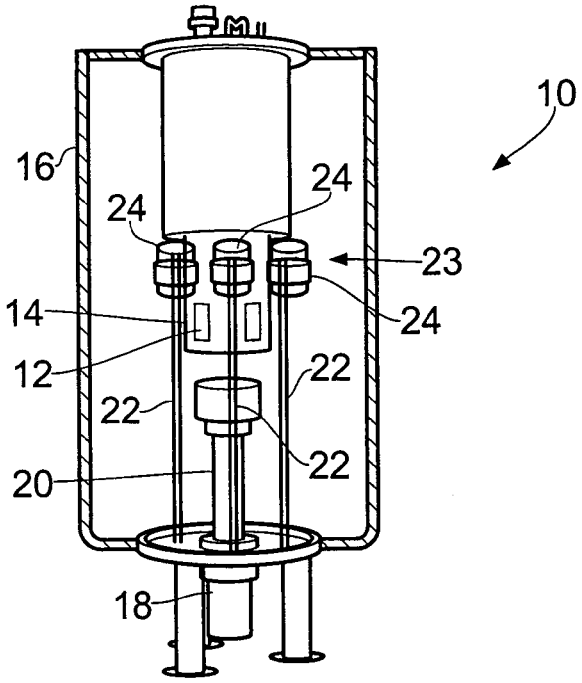
FIG. 1 shows a cooling arrangement for an electrical connector for a superconductor according to the present invention.
Figure 2:
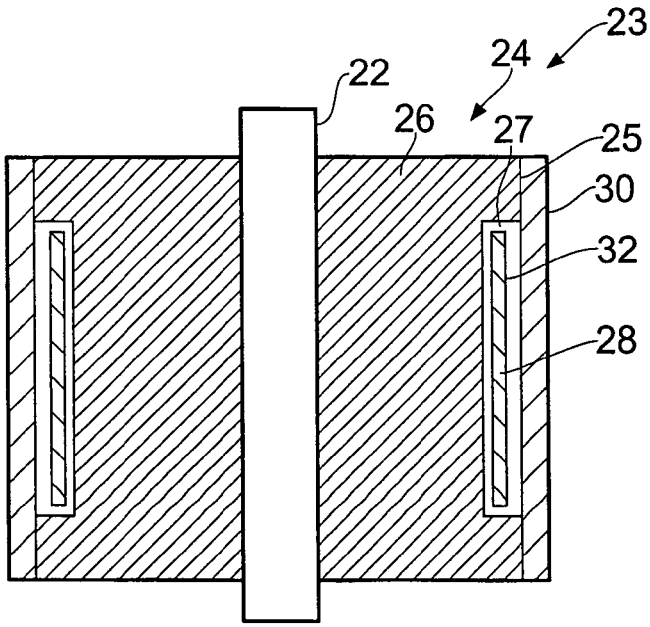
FIG. 2 is an enlarged vertical longitudinal cross-sectional view through the cooling arrangement in FIG. 1.
Figure 3:
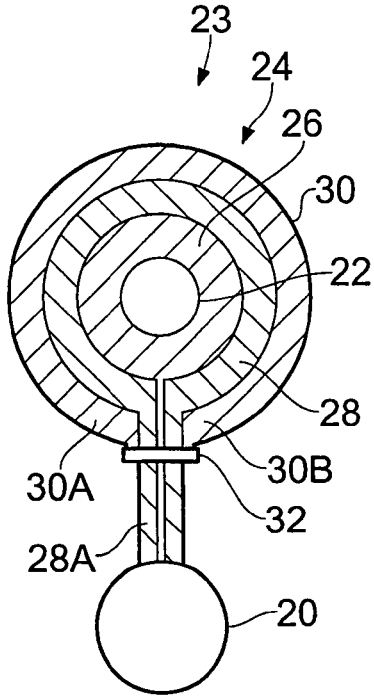
FIG. 3 is an enlarged horizontal cross-sectional view through the cooling arrangement in FIG. 1.

A cooling arrangement 23 for an electrical connector 22 for a superconductor 12, as shown in FIGS. 1, 2 and 3 comprises at least one superconductor 12 arranged in a container 14 and the container 14 is arranged in a vacuum chamber 16. A cryocooler 18 is thermally connected to the container 14 to cool the container 14 and the contents of the container 14 including the superconductor 12. The cryocooler 18 is positioned vertically below, underneath, the container 14 and a thermally conducting member, a cold head extension, 20 extends vertically upwards to thermally contact the bottom of the container 14. One or more electrical connectors 22 extend through the vacuum chamber 16 and the container 14 to the at least one superconductor 12. Each of the electrical connectors 22 has a thermally conducting and electrically insulating arrangement 24. Each thermally conducting and electrically insulating arrangement 24 comprises an electrically insulating member 26 which contacts the respective electrical connector 22. A thermally conducting member 28 contacts the electrically insulating member 26 and the thermally conducting member 28 is thermally connected to the cryocooler 18 to cool the electrical connector 22.

In the arrangement shown in FIGS. 2 and 3 each thermally conducting and electrically insulating arrangement 24 comprises a hollow electrically insulating member 26 which surrounds the electrical connector 22, a hollow thermally conducting member 28 surrounds the hollow electrically insulating member 26 and the hollow thermally conducting member 28 is thermally connected to the cryocooler 18 to cool the respective electrical connector 22. The hollow electrically insulating member 26 has a slot 27 around its periphery 25 and the hollow thermally conducting member 28 is arranged in the slot 27 in the periphery of the hollow electrically conducting member 26. The thermally conducting member 28 has a portion 28A which extends to the thermally conducting member 20 of the cryocooler 18. The hollow thermally conducting member 28 comprises a thermally conducting member arranged as a loop around the hollow insulating member 26. In addition a further electrical insulating member 30 surrounds the thermally conducting member 28 and a clamp 32 is arranged to put the ends 30A and 30B of the further electrical insulating member 30 into tension by pulling the ends 30A and 30B together to compress the thermally conducting and electrically insulating arrangement 24 around the respective electrical connector 22. There may be two clamps for each thermally conducting and electrically insulating assembly 24 positioned above the entrance and below the exit of the portion 28A of the thermally conducting member 28 from the thermally conducting and electrically insulating assembly 24 to guide the portions 28A to reduce the risk of electrical discharge from the respective electrical connector 22. In this arrangement each hollow electrically insulating member 26 is an elongate ring.

The container 14 generally comprises a metal, e.g. copper. The thermally conducting member 28 comprises brass, aluminium or copper. The thermally conducting member 28 may comprise a braided conducting member to allow for thermal contraction differences within the slot 25 and thermal contraction between the thermally conducting and electrically insulating assembly 24 and the cold head extension 20. The braided conducting member is smaller than the slot 25 at room temperature to ensure good contact with the hollow electrically insulating member 26. The aluminium may be anodised aluminium. The hollow electrically insulating member 26 comprises nylon, PTFE, alumina or sapphire.

Conducting wool may be arranged in the slot 27 in the hollow electrically insulating member 26 with the thermally conducting member 28. The conducting wool may comprise copper wool. The conducting wool is compressed under differential thermal contraction at operational temperature.

The electrical connectors 22 comprise a solid copper cable, a stranded copper cable or a copper busbar. The electrical connector 22 may or may not have electrical insulation on it. However, each electrical connector 22 does not have any insulation at the region where the respective thermally conducting and electrically insulating arrangement 24 is arranged in contact with the electrical connector 22.

The thermally conducting and electrically insulating arrangement 24 is fitted over the bare electrical connector 22 with a light interference fit. The thermally conducting and electrically insulating arrangement 24 is selected such that it has a higher thermal contraction than the bare electrical connector 22 so that at operational temperatures a tight interference fit is provided to ensure maximum heat transfer within a vacuum environment within the vacuum chamber 16.

Each thermally conducting and electrically insulating arrangement 24 is retained by a non-electrically conducting support structure which is connected to the vacuum chamber 16 or the container 14

The superconductor 12 is preferably a superconducting fault current limiter. Preferably there are three superconductors 12 in the container to provide a superconducting fault current limiter for each one of three electrical phases. It is to be noted that although there are three electrical connectors 22 shown in FIG. 2, actually two electrical connectors 22 are required for each electrical phase. Alternatively there may be three superconductors and three containers and each superconductor is provided in a respective one of the containers within the vacuum chamber.

The advantage of the present invention is that it enables operation at high voltages whilst continuing to operate without the need for a cryogenic liquid coolant, it provides an additional mechanical support for the electrical connector, thermal contraction ensures good thermal contact with the insulation arrangement, a braided conducting member and conducting wool allows for differential contraction rates.

The thermal connection between the thermally conducting member and the cold head extension may be a solid connection, a stranded connection or a braided connection, e.g. stranded copper or braided copper.

Figure 4:
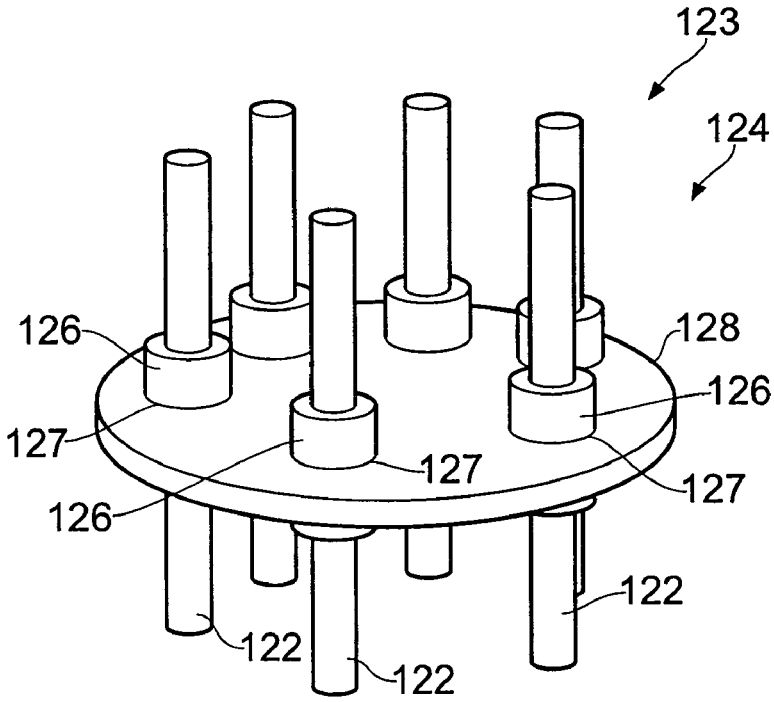
FIG. 4 shows a perspective view of a further cooling arrangement for an electrical connector for a superconductor according to the present invention.
Figure 6:
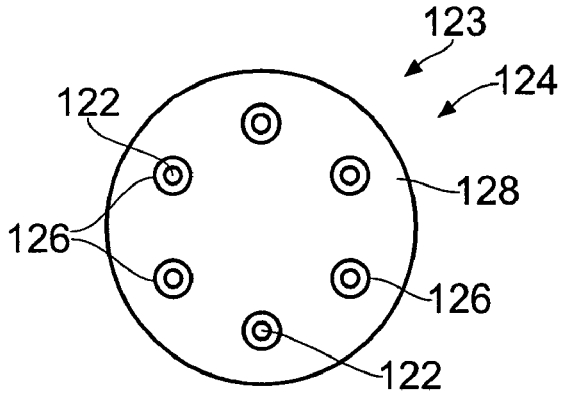
FIG. 6 is a plan view of the cooling arrangement shown in FIG. 4.
Figure 5:
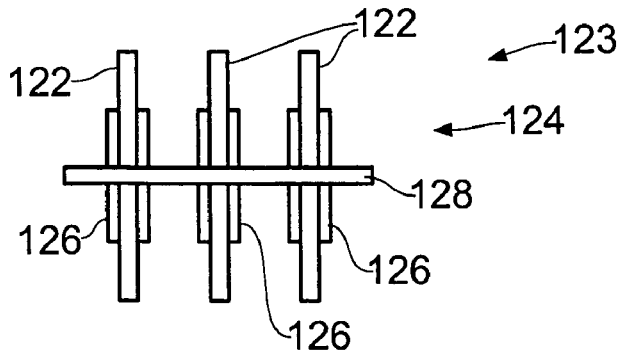
FIG. 5 is a longitudinal side view of the cooling arrangement shown in FIG. 4.

A further cooling arrangement 123 comprising a thermally conducting and electrically insulating arrangement 124 for an electrical connector 122 for a superconductor is shown in FIGS. 4, 5 and 6. The thermally conducting and electrically insulating arrangement 124 comprises a hollow electrically insulating member 126 which surrounds the electrical connector 122. A thermally conducting member 128 surrounds the hollow electrically insulating member 126 and the thermally conducting member 128 is thermally connected to the cryocooler to cool the electrical connector 122.

In this thermally conducting and electrically insulating arrangement 124 the thermally conducting member 128 comprises a thermally conducting plate 128 which has at least one aperture 127 and the electrical connector 122 extends through the at least one aperture 127. The hollow electrically insulating member 126 is positioned in the at least one aperture 127 between the at least one electrical connector 122 and the thermally conducting plate 128.

Furthermore in this thermally conducting and electrically insulating arrangement 124, the thermally conducting plate 128 has a plurality of apertures 127, a plurality of electrical connectors 122 and a plurality of hollow electrically insulating members 126. Each electrical connector 122 extends through a respective one of the apertures 127. Each hollow electrically insulating member 126 is positioned in a respective one of the apertures 127 and each hollow electrically insulating member 126 is position between the respective one of the electrical connectors 122 and the thermally conducting plate 128.

In this example the thermally conducting plate 128 has six apertures 127 and there are six electrical connectors 122. There are six electrical connectors 122 because each superconductor requires two electrical connectors 122 and there are three superconductors in the container, or there are three containers in the vacuum chamber and a superconductor is provided in each of the containers.

In this arrangement each aperture is circular in cross-section and each hollow electrically insulating member 126 is an elongate ring. However, the apertures may have other cross-sectional shapes and the electrically insulating member has a corresponding shape to match.

The thermally conducting plate 128 comprises an aluminium plate. The aluminium plate 128 may be an anodised aluminium plate. The hollow electrically insulating members 126 comprise alumina or sapphire.

Figure 7:
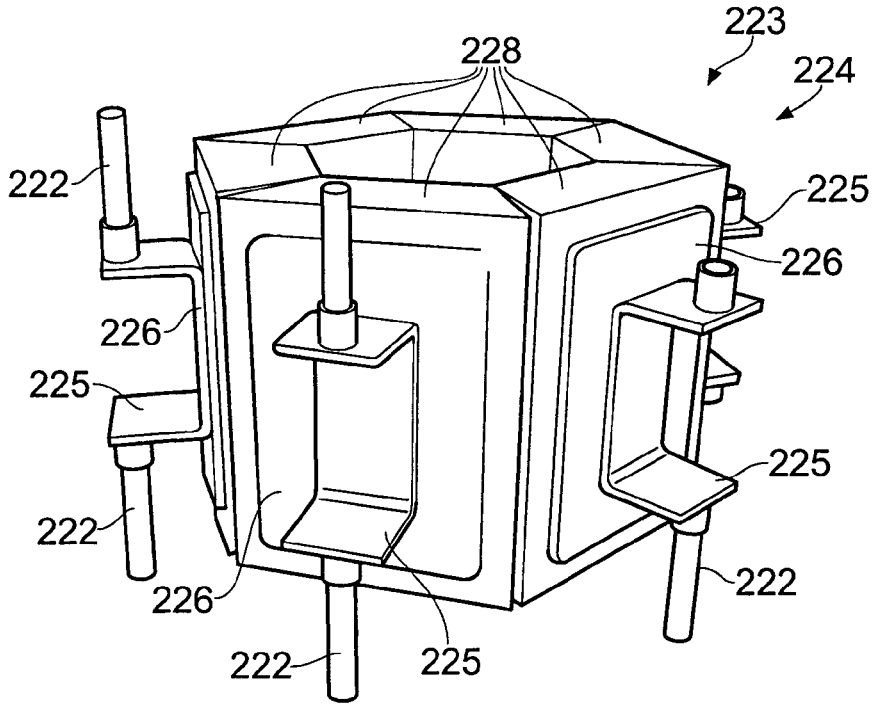
FIG. 7 shows a perspective view of another cooling arrangement for an electrical connector for a superconductor according to the present invention.
Figure 8:
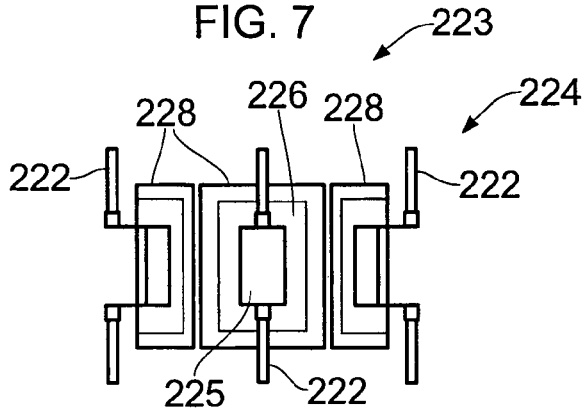
FIG. 8 is a longitudinal side view of the cooling arrangement shown in FIG. 7.
Figure 9:
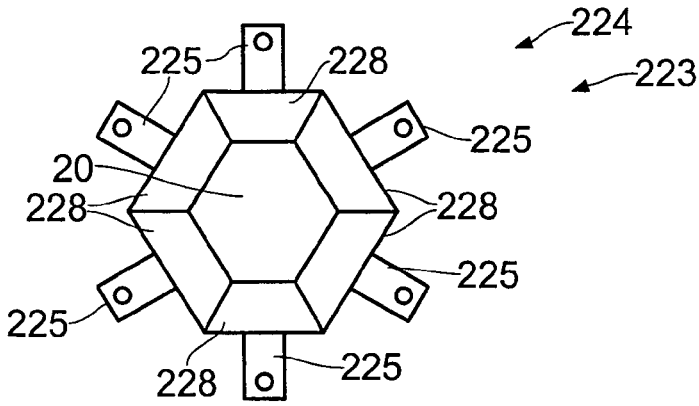
FIG. 9 is a plan view of the cooling arrangement shown in FIG. 7.

Another cooling arrangement 223 comprising a thermally conducting and electrically insulating arrangement 224 for an electrical connector 222 for a superconductor is shown in FIGS. 7, 8 and 9. A portion of the electrical connector 222 comprises a U-shaped plate member 225. The thermally conducting and electrically insulating arrangement 224 comprises an electrically insulating plate 226 contacting the U-shaped plate member 225 portion of the electrical connector 222. A thermally conducting member 228 contacts the electrically insulating plate 226 and the thermally conducting member 228 is thermally connected to the cryocooler to cool the electrical connector 222.

In this arrangement there are a plurality of electrical connectors 222 and a portion of each electrical connector 222 comprises a U-shaped plate member 225. A plurality of electrically insulating plates 226 and a plurality of thermally conducting members 228 are provided. Each electrically insulating plate 226 contacts the U-shaped plate portion 225 of a respective one of the electrical connectors 222 and each thermally conducting member 228 contacts a respective one of the electrically insulating plates 226.

The plurality of electrical connectors 222 are arranged around the cryocooler and the thermally conducting members 228 are arranged on the sides of a polygon. In this example there are six electrical connectors 222 and each thermally conducting member 228 is arranged on the side of a hexagon. There are six electrical connectors 222 because each superconductor requires two electrical connectors 222 and there are three superconductors in the container, or there are three containers in the vacuum chamber and a superconductor is provided in each of the containers.

The thermally conducting member 228 comprises brass, aluminium or copper. The electrically insulating plate 226 comprises alumina or sapphire. The U-shaped plate member 223 comprises brass, aluminium or copper.

In this thermally conducting and electrically insulating arrangement 224 each electrical connector 222 is connected to the ends of the limbs of the respective U-shaped plate member 225 so that the electrical current flows through the U-shaped plate member 225. The U-shaped plate member 225 is thermally connected to a more massive thermally conducting member 228 by an electrically insulating plate 226, which provides electrical isolation but reasonably good thermal conduction. The thermally conducting member 228 is directly thermally connected to the cold head extension 20 of the cryocooler 18. It is preferred that the electrically insulating plate 226 covers the whole of the surface of the thermally conducting member 228 facing the U-shaped plate member 225, to prevent electrical discharge between the U-shaped plate member 225 and the thermally conducting member 228.

The U-shaped plate member 225 may be vacuum brazed or diffusion bonded to the electrically insulting plate 226 and the thermally conducting member 228 may be vacuum brazed or diffusion bonded to the electrically insulating plate 226.

The thermally conducting and electrically insulating arrangement of FIGS. 7, 8 and 9 is similar to that shown in FIGS. 4, 5 and 6 but differs in that heat is conducted linearly in FIGS. 7, 8 and 9 rather than radially as in FIGS. 4, 5 and 6. Thus, the thermally conducting and electrically insulating arrangement of FIGS. 7, 8 and 9 has the advantage of overcoming problems due to differential radial expansion of the components in FIGS. 4, 5 and 6.

It may be possible to provide more than one cryocooler such that if one of the cryocoolers fails the remaining cryocoolers are able to cool the container and contents and the electrical connector.

The superconductor preferably comprises magnesium diboride, but other suitable materials may be used.

Although the present invention has been described with reference to a superconductor for a superconducting fault current limiter it is also applicable to a superconductor for a superconducting electrical machine or a superconductor for other purposes.

The invention claimed is:

1. A cooling arrangement for an electrical connector for a superconductor comprising at least one superconductor arranged in a container, the container being arranged in a vacuum chamber, a cryocooler thermally connected to the container to cool the container and the contents of the container, the electrical connector extending through the vacuum chamber and the container to the at least one superconductor, the electrical connector having a thermally conducting and electrically insulating arrangement, the thermally conducting and electrically insulating arrangement comprising an electrically insulating member contacting the electrical connector, a thermally conducting member contacting the electrically insulating member and the thermally conducting member being thermally connected to the cryocooler to cool the electrical connector, wherein the thermally conducting and electrically insulating arrangement comprises a hollow electrically insulating member surrounding the electrical connector, the thermally conducting member surrounding the hollow electrically insulating member, the thermally conducting member being thermally connected to the cryocooler to cool the electrical connector.

2. A cooling arrangement as claimed in claim 1 wherein the thermally conducting member comprises a thermally conducting plate having at least one aperture, the electrical connector extending through the at least one aperture, the hollow electrically insulating member being positioned in the at least one aperture between the at least one electrical connector and the thermally conducting plate.

3. A cooling arrangement as claimed in claim 2 wherein the thermally conducting plate has a plurality of apertures, a plurality of electrical connectors, a plurality of hollow electrically insulating members, each electrical connector extending through a respective one of the apertures, each hollow electrically insulating member being positioned in a respective one of the apertures, each hollow electrically insulating member being position between the respective one of the electrical connectors and the thermally conducting plate.

4. A cooling arrangement as claimed in claim 2 wherein the thermally conducting plate comprise an aluminium plate.

5. A cooling arrangement as claimed in claim 4 wherein the aluminium plate is an anodised aluminium plate.

6. A cooling arrangement as claimed in claim 1 wherein the thermally conducting and electrically insulating arrangement comprises a hollow electrically insulating member surrounding the electrical connector, the thermally conducting member surrounding the hollow electrically insulating member, the thermally conducting member being thermally connected to the cryocooler to cool the electrical connector, a further electrical insulating member surrounding the thermally conducting member and a clamp surrounding the further electrical insulating member to compress the thermally conducting and electrically insulating arrangement.

7. A cooling arrangement as claimed in claim 6 wherein the thermally conducting member comprises a braided conducting member.

8. A cooling arrangement as claimed in claim 6 wherein the hollow electrically insulating member has a slot around its periphery and the thermally conducting member is arranged in the slot in the hollow electrically conducting member.

9. A cooling arrangement as claimed in claim 8 wherein a conducting wool is arranged in the slot in the hollow electrically insulating member with the thermally conducting member.

10. A cooling arrangement as claimed in claim 9 wherein the conducting wool comprise copper wool.

11. A cooling arrangement as claimed in claim 1 wherein the electrical connector comprises a copper cable or a copper busbar.

12. A cooling arrangement as claimed in claim 1 wherein the thermally conducting member comprises copper, aluminium or brass.

13. A cooling arrangement as claimed in claim 1 wherein the electrically insulating member comprises alumina or sapphire.

* * * * *